US010058789B2

(12) United States Patent
Styles

(10) Patent No.: US 10,058,789 B2
(45) Date of Patent: Aug. 28, 2018

(54) MODULAR PLAY STRUCTURE SYSTEM

(71) Applicant: Nicholas Styles, St. Paul, MN (US)

(72) Inventor: Nicholas Styles, St. Paul, MN (US)

(73) Assignee: Creative Styles LLC, St. Paul, MN (US)

( * ) Notice: Subject to any disclaimer, the term of this patent is extended or adjusted under 35 U.S.C. 154(b) by 0 days.

(21) Appl. No.: 15/352,836

(22) Filed: Nov. 16, 2016

(65) Prior Publication Data

US 2017/0197153 A1 Jul. 13, 2017

Related U.S. Application Data

(66) Substitute for application No. 62/277,708, filed on Jan. 12, 2016.

(51) Int. Cl.
*A63H 33/00* (2006.01)
*A63H 33/10* (2006.01)
*B43L 1/00* (2006.01)

(52) U.S. Cl.
CPC ..... *A63H 33/008* (2013.01); *A63H 33/105* (2013.01); *B43L 1/00* (2013.01)

(58) Field of Classification Search
CPC ..... A63H 33/044; A63H 33/06; A63H 33/08; A63H 33/082; A63H 33/008; A63H 33/105; A63H 33/108
USPC ..... 446/105, 108, 110, 111, 112, 115; 52/79.9, 282.1–282.3, 586.2, 279, 284, 52/582.1, 311.1, 506.01, 610
See application file for complete search history.

(56) References Cited

U.S. PATENT DOCUMENTS 1,619,101 A * 3/1927 Chase ..... A63H 33/044 446/110
1,898,297 A * 2/1933 Fox ..... A63H 33/105 446/105
1,955,194 A * 4/1934 Leake ..... A63H 33/044 446/104
2,904,927 A * 9/1959 Katz ..... A63H 33/08 434/79
3,089,269 A * 5/1963 McKiernan ..... G09F 7/06 211/1
3,137,967 A * 6/1964 Flieth ..... A63H 33/08 273/157 R
3,186,561 A * 6/1965 Strassle ..... A47B 57/425 211/182
3,193,231 A * 7/1965 Curry ..... A47F 5/0823 24/DIG. 52
3,258,870 A * 7/1966 Offenhauer ..... G09F 7/06 40/622
3,661,434 A * 5/1972 Alster ..... A47B 47/005 312/108
3,685,664 A * 8/1972 Kramer ..... A47F 5/02 108/106

(Continued)

*Primary Examiner* — Robert Canfield
(74) *Attorney, Agent, or Firm* — Pauly, DeVries Smith & Deffner LLC

(57) ABSTRACT

A modular play structure is disclosed. The play structure has a plurality of wall units that can interchangeably couple to form a modular playhouse. The wall units are coupled together by a mating structure. Some embodiments have a separate connector that couples wall units together at the edges of the wall units. Some embodiments have accessories coupled to the wall units at accessory openings. Some embodiments have decorative façades configured to removably attach to the plurality of wall units.

19 Claims, 5 Drawing Sheets

(56) References Cited

U.S. PATENT DOCUMENTS 3,729,881 A * 5/1973 Disko ..... A63H 33/008 446/105
3,820,299 A * 6/1974 Verbolt ..... A47B 96/1466 312/330.1
3,827,177 A * 8/1974 Wengel ..... A63H 33/101 446/112
4,304,382 A * 12/1981 Jelen ..... A47F 5/0823 211/89.01
4,594,829 A * 6/1986 Herrgord ..... E04B 2/7405 52/282.3
4,652,170 A * 3/1987 Lew ..... E04B 1/617 403/171
4,828,209 A * 5/1989 Niemi ..... A47F 5/0823 248/220.42
5,306,198 A * 4/1994 Forman ..... A63F 9/0098 446/116
5,428,914 A * 7/1995 Whitehouse ..... G09F 7/06 40/594
D361,631 S * 8/1995 King ..... D25/128
5,470,139 A * 11/1995 Hsiao ..... A47B 47/005 312/111
5,554,062 A * 9/1996 Goldsen ..... A63F 9/0098 434/171
5,555,660 A * 9/1996 Whitehouse ..... G09F 7/06 40/594
5,647,181 A * 7/1997 Hunts ..... A63H 33/10 312/111
5,918,999 A * 7/1999 Lamarca ..... F16B 5/0044 403/384
6,065,258 A * 5/2000 McClatchy ..... B44C 7/022 40/606.03
6,068,533 A * 5/2000 Glickman ..... A63H 33/101 446/108
6,089,941 A * 7/2000 Glickman ..... A63H 33/101 446/108
6,176,757 B1 * 1/2001 Lin ..... A63H 33/101 446/102
6,238,261 B1 * 5/2001 Lang ..... A63H 33/22 434/407
6,397,551 B1 6/2002 Lewcock et al.
8,209,917 B1 * 7/2012 DeZaio ..... E04C 2/384 52/285.3
8,474,193 B2 * 7/2013 Sutton ..... A47B 46/005 52/27
8,789,325 B2 * 7/2014 Verhaeghe ..... E04B 2/705 4/524
8,904,706 B1 * 12/2014 Smith ..... A01G 9/00 47/65.6
9,114,325 B1 * 8/2015 Sternhill ..... A63H 33/067
2004/0033877 A1 * 2/2004 Muehlmeier ..... A63H 33/008 493/480
2004/0074158 A1 * 4/2004 De Zen ..... E04B 1/12 52/79.9
2004/0187417 A1 * 9/2004 Thomas ..... B44C 5/00 52/311.1
2004/0198141 A1 * 10/2004 Buhrman ..... A63H 33/008 446/85
2004/0250480 A1 * 12/2004 Matthai ..... A47B 21/00 52/36.1
2007/0294953 A1 * 12/2007 Guillen ..... A47B 57/40 52/36.1
2010/0011694 A1 * 1/2010 Spaans ..... B29C 33/62 52/586.1
2010/0293885 A1 * 11/2010 Ceccotti ..... E04B 1/04 52/745.13
2014/0155182 A1 * 6/2014 DeBlanco ..... A63H 33/008 472/136

* cited by examiner

MODULAR PLAY STRUCTURE SYSTEM

CROSS-REFERENCE TO RELATED APPLICATION

This application claims priority from U.S. Provisional Patent Application No. 62/277,708, filed Jan. 12, 2016, the contents of which are herein incorporated by reference in their entirety.

SUMMARY

An aspect of the disclosure relates to a modular play structure system having a first wall unit with a first-wall face and a first-wall edge defining a mating structure. The modular play structure also has a second wall unit with a second-wall face and a second-wall edge. The second-wall edge is configured to be releasably coupled to the first-wall edge. The modular play structure may include at least one accessory opening defined by the first-wall face and a plurality of accessories each configured to releasably couple with the at least one accessory opening.

In some embodiments, the first wall unit and the second wall unit each have one of the following shapes: a square, a rectangle, and an L-shape. In some embodiments, each of the plurality of accessories has a peg that is configured to be received by the at least one accessory opening. In some embodiments, the first-wall face and the second-wall face each have a writable-erasable coating. Some embodiments have at least one accessory opening defined by the second-wall face, and each of the plurality of accessories is configured to releasably couple with the accessory opening of the second-wall face. Some embodiments include a plurality of decorative façades configured to removably attach to the first-wall face. In some embodiments, each of the decorative façades defines an opening configured to align with the at least one accessory opening. In some embodiments, the first wall unit includes a plurality of first-wall edges each defining mating structures, and the second wall unit is configured to be releasably coupled to each mating structure of each of the first-wall edges. In some embodiments, the first wall unit has a length of at least two feet and the first-wall face has an area of at least two feet squared.

Some embodiments include a connector, separate from the first-wall edge and the second-wall edge, configured to releasably couple the first wall edge and the second wall edge. In some embodiments, the connector releasably interlocks at least 75% of the length of the first-wall edge and at least 75% of the length of the second-wall edge with a friction fit.

An aspect of the disclosure relates to a modular play structure having a plurality of wall units each defining at least two coupleable wall edges. Each of the coupleable wall edges define an elongate interlocking structure. The modular play structure may include a plurality of connectors each defining two or more elongate receiving structures. In some embodiments, each receiving structure is configured to releasably interlock with each interlocking structure to couple at least two of the plurality of wall units.

In some embodiments, each of the plurality of connectors defines four elongate receiving structures. In some embodiments, each of the four elongate receiving structures has a width that is perpendicular to an adjacent elongate receiving structure on the connector. In some embodiments, at least one of the plurality of connectors is slidable relative to each of the elongate interlocking structures. In some embodiments, at least one of the plurality of wall units has two coupleable wall edges that are perpendicular, and the wall unit has one of the following shapes: a rectangle, a square, and an L-shape.

In some embodiments, each of the plurality of wall units has at least three coupleable wall edges. In some embodiments, each of the plurality of wall units defines at least one accessory opening, and the play structure further has a plurality of accessories each configured to releasably couple with each of the accessory openings.

Some embodiments include a plurality of decorative façades configured to removably attach to at least a portion of the plurality of wall units. In some embodiments, each wall unit has a length of at least two feet and an area of at least two feet squared.

Further details are found in the detailed description and appended claims. Other aspects will be apparent to persons skilled in the art upon reading and understanding the following detailed description and viewing the drawings that form a part thereof.

BRIEF DESCRIPTION OF THE DRAWINGS

Examples may be more completely understood in connection with the following Figures. In the Figures, like reference numerals designate corresponding parts throughout the different views.

While embodiments herein are susceptible to various modifications and alternative forms, specifics thereof have been shown by way of example and drawings, and will be described in detail. It should be understood, however, that the scope of the technology disclosed herein is not limited to the particular examples described. On the contrary, the intention is to cover modifications, equivalents, and alternatives falling within the spirit and scope of the present disclosure.

DETAILED DESCRIPTION

Figure 1:
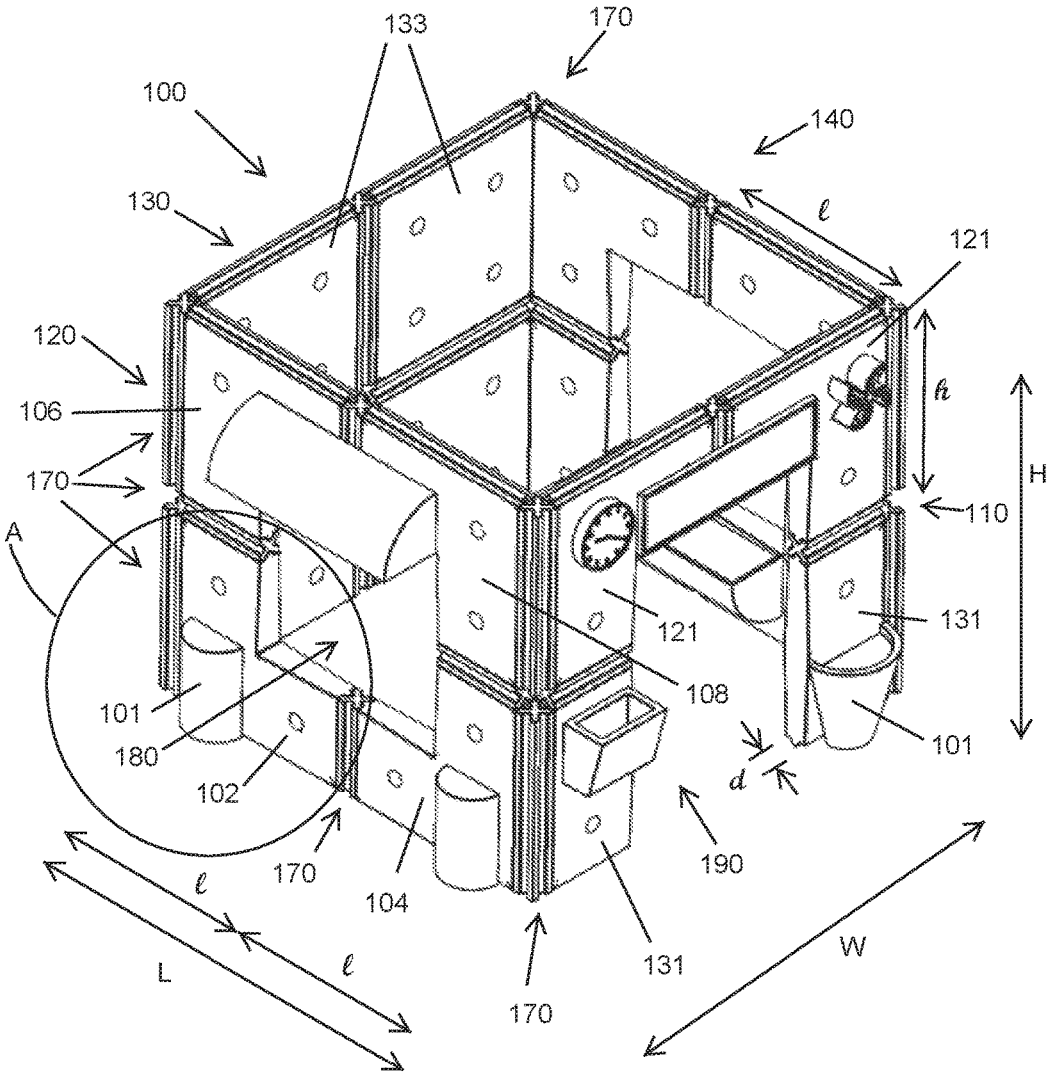
FIG. 1 is a perspective view of an exemplary implementation of a modular play cube system consistent with the technology disclosed herein.
Figure 2:
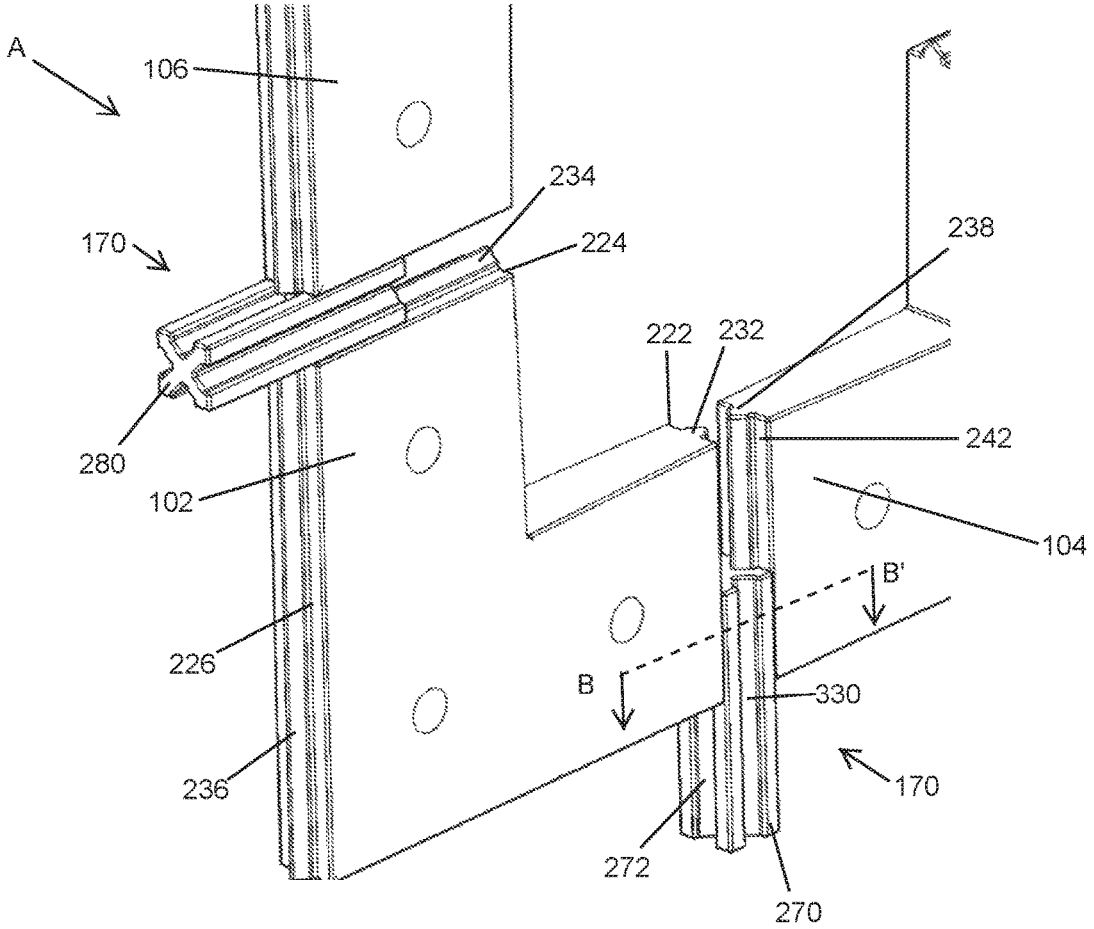
FIG. 2 is a perspective detail view of an embodiment of the example of FIG. 1.
Figure 3:
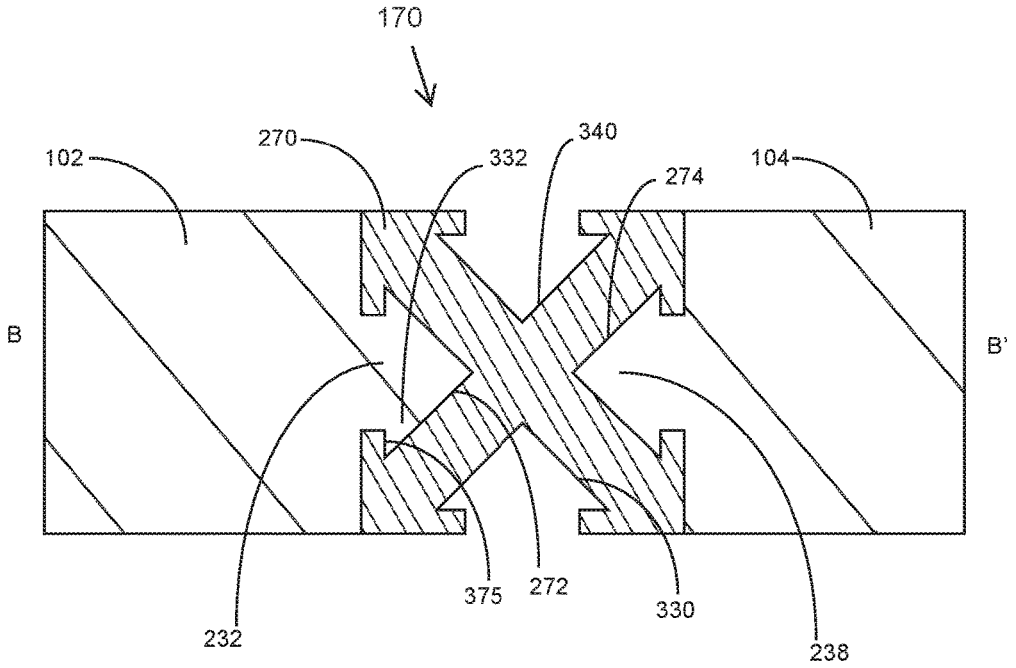
FIG. 3 is a cross-sectional view of the embodiment of FIG. 2.

FIGS. 1, 2, and 3 illustrate a modular play structure having multiple wall units that can be interchangeably connected to create multiple different structural configurations. FIG. 1 shows an example implementation of a modular play structure 100. The modular play structure 100 is formed from interchangeable components that can be arranged and rearranged to construct customized playhouses that approximate real locations such as a police station, hospital, post office, lemonade stand, or fire station. The play structure 100 has a plurality of walls. In the example of FIG. 1, the play structure 100 has a front wall 110, a back wall 130, a first side wall 120, and second side wall 140. In some embodiments, the walls can define openings for windows and entry-ways. For example, the front wall 110 defines a door opening 190, and the first side wall 120 defines a window opening 180. Some embodiments of the modular play structure 100 include a plurality of accessories 101, which will be discussed later in relation to FIG. 4.

Each of the walls of the modular play structure 100 are formed from smaller, individual wall units. The wall units cumulatively define the walls and the openings of the play structure 100. The wall units can have various different shapes and sizes. In the example of FIG. 1, a first exemplary wall unit 121 is an L-shaped wall unit, a second exemplary wall unit 131 is a rectangular wall unit, and a third exemplary wall unit 133 is a square wall unit. The variety of shapes of the wall units allows a user to mix and match the wall units and arrange the wall units in a multitude of different arrangements. In some embodiments, a plurality of the wall units are substantially identical, where the phrase "substantially identical" is used herein to mean that the units are the same size, shape, and construction, with the exception of minor inconsistencies such as manufacturing imperfections. In some embodiments, each of the plurality of L-shaped wall units are substantially identical, each of the plurality of square wall units are substantially identical, and each of the plurality of rectangular wall units are substantially identical.

In the example of FIG. 1, the first side wall 120 is formed from four L-shaped wall units 102, 104, 106, and 108 that cumulatively define the window opening 180. The front wall 110 is formed from two L-shaped wall units 121 and two rectangular wall units 131 that cumulatively define the door opening 190. The back wall 130 is formed from four square wall units 133. Generally L-shaped wall units can be used to construct walls defining window openings and square wall units can be used to construct walls having no window openings.

The play structure 100 is generally sized to accommodate children's play. The play structure 100 has a width W, a length L, and a height H. The width W, length L, and height H of the play structure 100 are determined by the size and number of wall units coupled together by a user. Each of the wall units have a horizontal dimension l, a vertical dimension h, and a depth d. The horizontal dimension l of the wall units correlate to the length L and the width W of the play structure 100, and the vertical dimension h of the wall units correlates to the height H of the modular play structure 100. The depth d is the thickness of the wall units.

In some embodiments, all of the wall units have the same vertical dimensions h. In some embodiments, the rectangular wall units 131 have the same vertical dimensions h as the L-shaped wall units 121 and the square wall units 133, but have a smaller horizontal dimension l. This allows the door opening 190 to be created from two rectangular wall units 131 and two L-shaped wall units 121. In some embodiments, a plurality of wall units can be used to construct the play structure 100 in a plurality of orientations. For example, a plurality of the wall units—such as the square wall units and the L-shaped wall units—have equal horizontal dimensions l and vertical dimensions h, such that the horizontal dimension l and vertical dimension h are interchangeable.

In embodiments consistent with the current example implementation, the total width W of the play structure 100 is defined by two wall units coupled side by side; in some other embodiments the width W is defined by three, four, or more wall units coupled side by side. In some embodiments the total length L of play structure 100 is defined by two, three, four, or more wall units coupled side by side. In some embodiments the total height H is defined by at least two wall units arranged vertically. In some embodiments, the height H is defined by three, four, or more wall units arranged vertically. In the example of FIG. 1, the height H of the play structure 100 is the sum of the vertical dimensions h of two wall units arranged vertically (e.g., the first wall unit 102 and the third wall unit 106), and the width W and the length L of the play structure 100 is defined by the sum of the horizontal dimensions l of two wall units arranged side by side (e.g., the length L is the sum of the horizontal dimensions l of the first wall unit 102 and the second wall unit 104).

The dimensions of the wall units are configured to define a structure sized for children's play when assembled. In some embodiments, the square wall units 133 can measure between about one foot and three feet horizontally and vertically (being square, the horizontal dimension l of wall unit 133 is approximately equal to the vertical dimension h). The rectangular wall units 131 can measure between about one foot and three feet vertically and between about six inches and two feet horizontally. The L-shaped wall units 121 can measure between about one foot and three feet horizontally and between about one foot and three feet vertically.

In an example embodiment, the square wall units 133 measure about two feet horizontally by two feet vertically, the L-shaped wall units 121 can measure about two feet horizontally and two feet vertically, and the rectangular wall units 131 can measure about one foot horizontally and two feet vertically.

The depth of each of the wall units is generally equal. In some embodiments, the depth d of the wall units is between about one inch and six inches deep. In an example embodiment, the wall units 121, 131, 133 are between about three inches and five inches deep. In an example embodiment, the wall units are 3.5 to 4.5 inches deep.

In some embodiments, including that depicted in FIG. 1, at least one wall of the play structure 100 is defined by four individual wall units. In some embodiments, each wall of the play structure 100 is defined by at least three and no more than nine individual wall units. In addition to square, rectangular, and L-shaped wall units, some embodiments may incorporate wall units of other shapes, such as triangular, hexagonal, or irregular polygons. In some embodiments, (not shown), the play structure 100 could be constructed with wall units to create a floor or ceiling for the play structure 100. Additionally, it is contemplated that the play structure 100 can be constructed to define multiple levels. In FIG. 1, the footprint of the play structure 100 is square, but the modularity of the various embodiments allows the play structure 100 to have any number of different footprints. For example, the footprint could be rectangular, L-shaped, or irregularly shaped.

In an embodiment, the walls 110, 120, 130, 140 of the play structure 100 can have a height H of about at least 4 feet. In some embodiments, the total height H of the play structure 100 is at least 3 about feet high. In some embodiments, the total height H is between about 4 feet and about 6 feet high. In some embodiments, the width W of the play structure 100 is at least about 4 feet wide. In some embodiments, the width W of the play structure 100 is between about 4 feet wide and 6 feet wide. In some embodiments, the width W of the play structure 100 is greater than 6 feet wide. Similarly, in some embodiments, the length L of the play structure 100 is at least about 4 feet long. In some embodiments, the length L of the play structure 100 is between about 4 feet long and 6 feet long. In some embodiments, the length L of the play structure 100 is greater than 6 feet long.

The wall units can be constructed from a number of different materials. In some embodiments, the wall units can be constructed from plastic. In some embodiments, the wall units can be made from EVA (ethylene-vinyl acetate) foam or polyurethane foam. In some embodiments, the wall units include a PVC (polyvinyl chloride) plastic material. The wall units can alternatively be constructed from, e.g., wood or another suitable material. The wall units can be constructed from "sandwiched" materials, for example, layers of foam and plastic laminated together. In some embodiments, the wall units are constructed from sandwiched PVC plastic material and polyurethane foam. Some such laminates can be both relatively lightweight and relatively strong.

A writable-erasable coating can be applied to one or more outside surfaces of the wall units. The writable-erasable coating can allow children to write on the wall units and later erase the writings. In some embodiments, one or more outside surfaces of the wall units are coated with a primer. In some embodiments, the wall units are coated with chalkboard paint. In some examples, the writable-erasable coating is whiteboard paint.

FIG. 2 is a detail view depicting the area A of FIG. 1 (for clarity, the accessory 101 of FIG. 1 is not shown in FIG. 2). The wall units of the play structure 100 can be releasably coupled at the wall edges of the wall units. Generally the edges of the wall units that are configured to be coupled to the edges of other wall units are referred to herein as "coupleable wall edges." In various embodiments, each wall unit in a modular play structure system defines at least two coupleable wall edges. In some embodiments, each wall unit in a modular play structure system defines at least three coupleable wall edges. In the example of FIG. 2, mating structures 170 are configured to releasably couple coupleable wall edges of two or more wall units. The phrase mating structure refers generally to the mechanical configuration of the system components that enables coupling of the wall units of the play structure 100. In an example implementation of the technology, the mating structure 170 is defined, in part, by a first-wall edge 222 of the first wall unit 102. The second-wall edge 242 is configured to be releasably coupled to the first-wall edge 222. In some embodiments, a second-wall edge 242 of the second wall unit 104 defines a portion of the mating structure. In some embodiments, a connector 270 defines a portion of the mating structure, which will be described in more detail below.

In the example of FIG. 2, the mating structure is defined by an elongate interlocking structure 232 of the first wall edge 222. The mating structure is also defined by an elongate interlocking structure 238 of the second-wall edge 242. In the example of FIG. 2, the elongate interlocking structures 232, 238 are in the form of a first rail and a second rail protruding from the first-wall edge 222 and the second-wall edge 242 respectively.

In some embodiments, the first wall unit 102 has a plurality of first-wall edges 222, 224, 226 each defining elongate interlocking structures 232, 234, and 236 respectively such that each of such first-wall edges are coupleable to another wall unit. The second wall unit 104 has at least one second-wall edge 242. The extension of the first elongate interlocking structure 234 is perpendicular to the extension of the second elongate interlocking structure 236, while the extension of the second elongate interlocking structure 236 is parallel to the extension of the third elongate interlocking structure 232. The second-wall edge 242 of the second wall unit 104 can be configured to releasably couple to any of the coupleable first-wall edges 222, 224, 226 via the mating structure 170.

In some embodiments, the play structure 100 has a plurality of connectors that partially define mating structures consistent with the technology disclosed herein, such as a first connector 270 and a second connector 280. Each connector 270, 280 is generally configured to couple two or more wall units together. FIG. 2 shows a perspective view of the connector 270, and FIG. 3 shows a cross-sectional view of the connector 270 and the first and second wall units 102, 104 along the line B-B' depicted in FIG. 2. In a variety of embodiments each of the connectors in a system consistent with the technology disclosed herein has a substantially identical configuration in the cross-sectional direction perpendicular to the length of the connector, which is the direction of the cross-section depicted in FIG. 3.

Consistently with the current figures, the first connector 270 is configured to releasably couple the first wall unit 102 and the second wall unit 104. The second connector 280 is configured to releasably couple the first wall unit 102 and a third wall unit 106. In some embodiments, the first connector 270 and the second connector 280 are substantially identical.

Generally each connector defines two or more elongate receiving structures, where each elongate receiving structure is configured to releasably interlock with each interlocking structure of coupleable wall edges of wall units to couple at least two wall units of the plurality of wall units. The first connector 270 defines a first elongate receiving structure 272 configured to releasably interlock with the third elongate interlocking structure 232 to couple the first wall unit 102 to the first connector 270. The first connector 270 also defines a second elongate receiving structure 274 configured to releasably interlock with the fourth elongate interlocking structure 238 to couple the second wall unit 104 to the connector 270. Each of the elongate receiving structures 272, 274 can be a groove configured to receive the elongate interlocking structures 232, 238.

In some embodiments, the connector 270 defines four elongate receiving structures 272, 274, 330, 340. Each of the elongate receiving structures 272, 274, 330, 340 is configured to receive an elongate interlocking structure of a wall unit, e.g., elongate interlocking structures 232 or 238. This makes the connector 270 in the example of FIGS. 2-3 capable of coupling up to four wall units (not shown). In the example of FIGS. 2-3, each of the four elongate receiving structures 272, 274, 330, 340 have a length and a width, where the width is perpendicular to the length. Further, each of the four elongate receiving structures 272, 274, 330, 340 has a width that is perpendicular to adjacent elongate receiving structures defined by the connector 270; e.g., the first elongate receiving structure 272 is adjacent and perpendicular to the fourth elongate receiving structure 340, and the first elongate receiving structure 272 is also adjacent and perpendicular to the third elongate receiving structure 330. When wall units are coupled to adjacent elongate receiving structures, each wall unit can form a 90-degree angle with an adjacent wall unit. Referring to the example of FIG. 1, the wall unit 104 is adjacent to a wall unit 131, and the wall units 104, 131 are connected at a 90-degree angle by a mating structure 170 to form a corner of the play structure 100. In some embodiments, the adjacent elongate receiving structures could be configured to couple the wall units at angles smaller or larger than 90 degrees.

In embodiments consistent with the current figure, the elongate interlocking structure 232 defines a rail 332 and the elongate receiving structure 272 defines a recess 375. The recess 375 is configured to engage with the rail 332 of the elongate interlocking structure 232. By engaging with the rail 332, the recess 375 prevents the elongate interlocking structure 232 from sliding out of—or translating relative to—the elongate receiving structure 272.

The elongate interlocking structure 232 and the elongate receiving structure 272 can have a variety of alternate configurations. In some embodiments, the elongate interlocking structure 232 is slidable relative to the elongate receiving structure 272. In some embodiments, the elongate interlocking structure 232 and the elongate receiving structure 272 can snap together. In some embodiments, the elongate interlocking structure 232 and the elongate receiving structure 272 are coupled together with a friction fit or an interference fit. In some embodiments one of the elongate interlocking structure 232 and the elongate receiving structure 272 defines a releasable clamp. In some other embodiments, one or both of the elongate interlocking structure and the elongate receiving structure can be defined by a plurality of discrete segments that extend along the length of the wall unit edge to cumulatively define the elongate interlocking structure and/or the elongate receiving structure.

The connector 270 can be constructed from any suitable material. In some embodiments, the connector 270 is constructed from a similar material to the wall units, for example, plastic, wood, polyurethane foam, or EVA foam. In some examples, the connector 270 is constructed from a material different from the wall units. The connectors can be constructed using a molding technique, e.g., blow molding or injection molding. Alternatively, the connector is constructed using machining techniques, e.g., the connector 270 may start as a solid block and the elongate receiving structures may be cut or carved out of the solid block.

Although FIGS. 2-3 illustrate one example implementation of a mating structure 170, the disclosed technology is not so limited, and it is contemplated that other mating structures are within the scope of the current technology and will be apparent to one of ordinary skill in the art. As one example, the separate connector 270 could be omitted. In such an embodiment, the first-wall edge of the first wall unit could have an integrally formed receiving structure (not shown) that is configured to directly couple the first-wall edge to a second-wall edge without the need for a separate connector.

Figure 4:
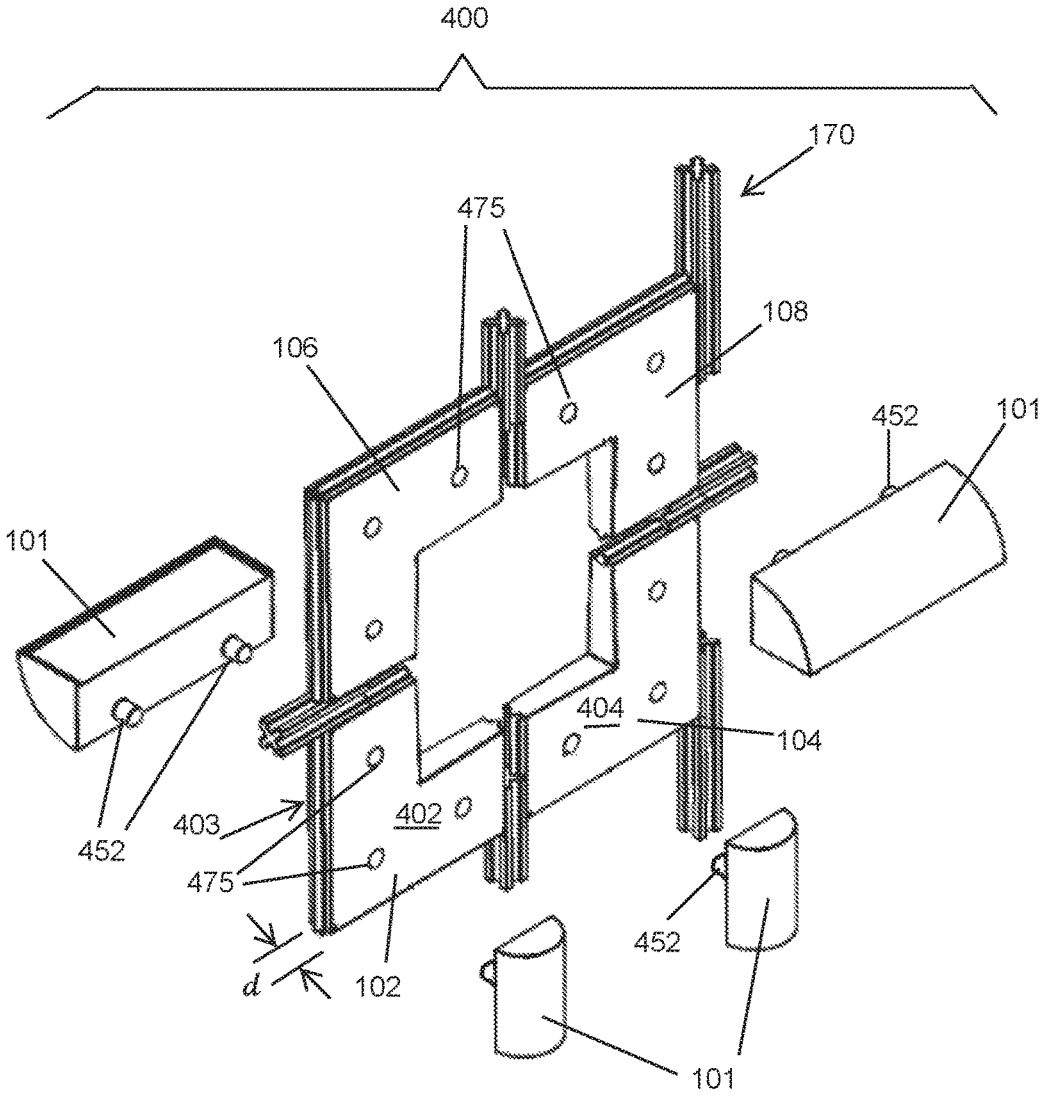
FIG. 4 is an exploded view of an embodiment of a modular play structure system.

FIG. 4 is an exploded view of an example side wall of a modular play structure system 400. The system has a plurality of wall units 102, 104, 106, 108 and a plurality of accessories 101 to create a modular play structure 100 such as that shown in FIG. 1. Similar to the example of FIGS. 1-3, the wall units 102, 104, 106, 108 are coupled using the one or more mating structures 170 that are mutually defined by system components.

The plurality of accessories 101 are configured to attach to the wall units 102, 104, 106, 108. The accessories 101 generally add structural details to the modular play structure 100. The structural details can be window ledges, awnings, clocks, signs, mail boxes, flower pots, and other similar components that add visual appeal to the modular play structure system 400.

In some embodiments, the accessories 101 have pegs 452 that couple to the wall units 102, 104, 106, 108 via the one or more pegs 452. The pegs 452 are configured to releasably attach to wall faces of the wall units, e.g., a first-wall face 402 of a first wall unit 102 and a second-wall face 404 of a second wall unit 104. Generally each of the plurality of accessories is configured to releasably couple with at least one accessory opening 475 defined by the first wall face 402. Each of the plurality of accessories can also be configured to releasably couple with at least one accessory opening 475 defined by the second wall face 404. In some embodiments, the wall units 102, 104, 106, 108 define accessory openings 475. The accessory openings 475 are configured to receive the pegs 452. Each of the pegs 452 is generally configured to be received by each of the accessory openings 475. This makes the accessories 101 interchangeable. In alternative embodiments, certain accessories could have differently configured pegs that can be received by only some of the accessory openings.

The one or more pegs 452 can be sized to pass completely through the accessory opening 475; that is, the length of the peg 452 can be approximately equal to or greater than the depth d of the wall units. In this case, an accessory opening 475 can accommodate only one accessory 101. In alternative embodiments, the length of the pegs 452 can be approximately equal to or less than one half the depth d of the wall units, which would allow accessories 101 to be inserted into the same accessory opening 475 from both the front face 402 and the back face 403 of the wall unit 102, where the phrase "front face" is intended to mean the face of the wall unit 102 configured to face outside of the play structure 100, and the phrase "back face" is intended to mean the face of the wall unit 102 configured to face the inside of the play structure 100.

Other methods of attaching the accessories 101 to the wall units are contemplated. For example, the accessories 101 could be attached using magnets or hook-and-loop fasteners. The accessories 101 could alternatively be provided with slots or holes, and the wall units could be provided with mating pegs. Other means of attaching the accessories 101 will be apparent to those of ordinary skill in the art.

In some embodiments, the accessories 101 are constructed from a similar material to the wall units, for example, plastic, wood, polyurethane foam, or EVA foam. In some examples, the accessories 101 are constructed from a material different from the wall units. The accessories 101 can be constructed using a molding technique, e.g., blow molding or injection molding. Alternatively, the accessories 101 can be constructed using machining techniques, e.g., the accessories 101 may start as a solid block and be cut or carved out of the solid block.

Figure 5:
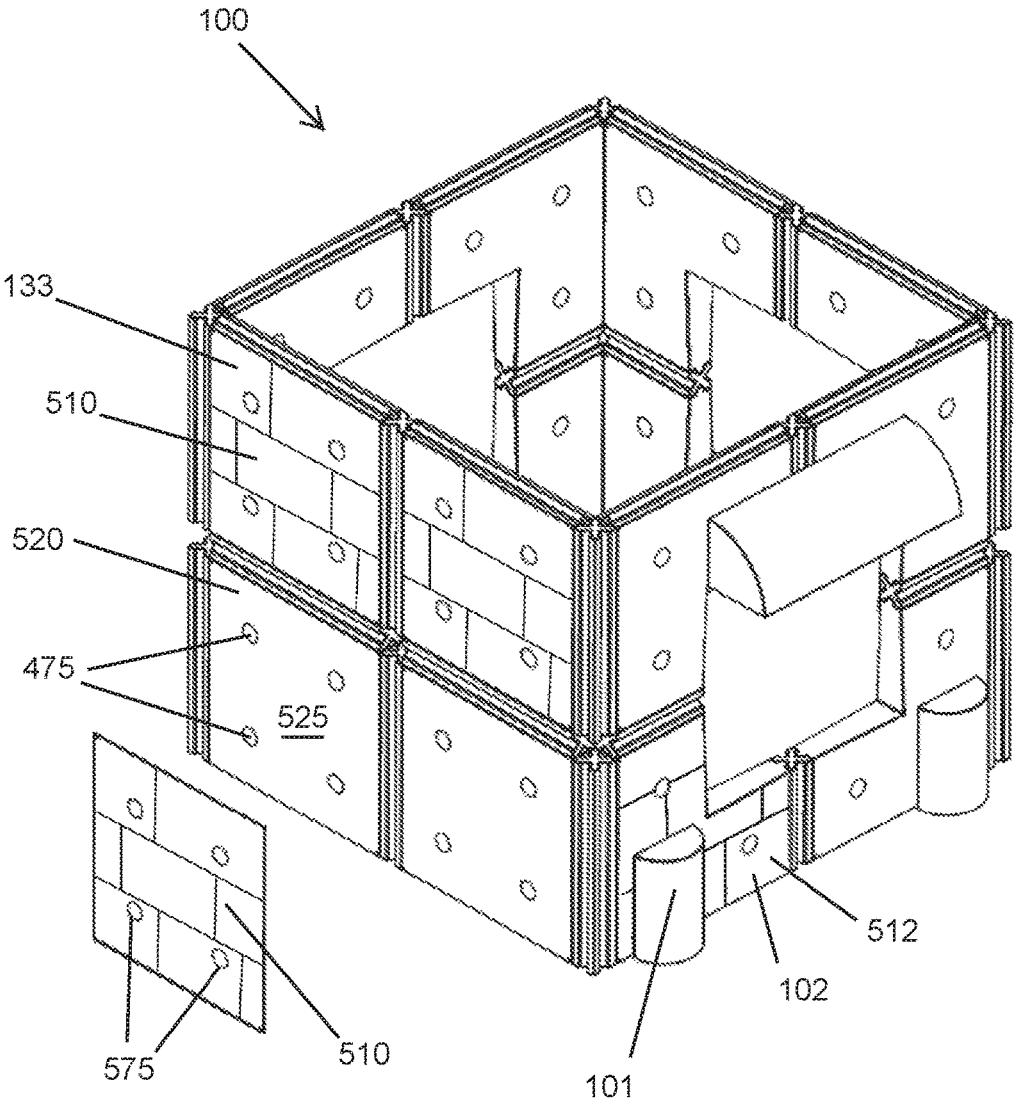
FIG. 5 is a perspective view of an embodiment of the modular play structure system.

FIG. 5 shows an embodiment in which a plurality of decorative façades can be added to the faces of the wall units. The decorative façades 510, 512 are configured to removably attach to at least a portion of the plurality of wall units. In FIG. 5, for example, the façade 510 is configured to be attached to the front face 525 of the wall unit 520. The façades 510 add design elements to the play structure 100 such as colors, images, patterns, or drawings. In some embodiments the façade has an image of building material that is reflective of a particular location that the play structure is configured to approximate. For example, if the play structure reflects a police station or a post office, a façade might reflect the image of a brick building wall. As another example, if the play structure is a lemonade stand, the façade might reflect the image of a wood wall.

The façades 510 can be removable and interchangeable, adding to the modularity of the play structure 100. The façades 510 are sized and shaped to fit on the front face of corresponding wall units. Therefore, L-shaped façades 512 are configured to removably attach to L-shaped wall units 102, 104; rectangular façades would be configured to couple to the rectangular wall unit 131. The decorative façades are generally configured to accommodate accessories described above. And, in embodiments consistent with the current figure, the decorative façades define openings 575 that are configured to align with accessory openings 475 defined on corresponding wall units.

The façades 510 can be constructed from a thin sheet of material or laminate. The façades 510 can be attached to the wall units by a variety of different methods. For example, magnets could be used to removably attach the façades 510 to the wall units. Alternatively, a relatively weak adhesive coating could be provided on one side of the laminate, making the façade 510 a removable "sticker." In some other embodiments, the façade 510 can be constructed of a material that forms a static bond with the surface of the wall unit, such as static cling stickers.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The present technology has been described with reference to various specific and preferred embodiments and techniques. However, it should be understood that many variations and modifications may be made while remaining within the spirit and scope of the technology.

What is claimed is:

1. A modular play structure comprising:

a plurality of wall units, each wall unit defining at least two coupleable wall edges that define an elongate interlocking structure, at least two of the plurality of wall units having an L-shaped wall face; and a plurality of connectors each defining four elongate receiving structures, wherein each receiving structure is configured to releasably interlock with each interlocking structure to couple at least two of the plurality of wall units;

wherein the at least two wall units having an L-shaped wall face are releasably interlockable by a connector to form either a portion of a door opening therebetween or a portion of a window opening therebetween.

2. The play structure of claim 1 wherein each of the four elongate receiving structures has a width that is perpendicular to an adjacent elongate receiving structure on a connector.

3. The play structure of claim 1 wherein at least one of the plurality of wall units has two coupleable wall edges that are perpendicular, and the at least one wall unit has one of the following shapes: a rectangle, a square, and an L-shape.

4. The play structure of claim 1 wherein each of the plurality of wall units has at least three coupleable wall edges.

5. The play structure of claim 1 wherein each of the plurality of wall units defines at least one accessory opening, and the play structure further comprises a plurality of accessories each configured to releasably couple with each of the at least one accessory opening.

6. The play structure of claim 1 further comprising a plurality of decorative façades configured to removably attach to at least a portion of the plurality of wall units.

7. The play structure of claim 1 wherein at least one of the plurality of connectors is slidable relative to each of the elongate interlocking structures.

8. The play structure of claim 1 wherein the play structure comprises a plurality of walls and each wall is defined by at least three and no more than sixteen wall units.

9. The play structure of claim 1 further comprising four wall units each having an L-shaped face, the four wall units defining elongate interlocking structures releasably interlockable by a plurality of connectors to form a window opening therebetween.

10. A modular play structure comprising:

a plurality of wall units, each wall unit defining at least two coupleable wall edges that define an elongate interlocking structure, wherein the plurality of wall units comprises four wall units each having an L-shaped wall face;

a plurality of connectors each defining two or more elongate receiving structures, wherein each receiving structure is configured to releasably interlock with each interlocking structure to couple at least two of the plurality of wall units;

and wherein the four wall units each having an L-shaped wall face are releasably interlockable by the plurality of connectors to form a window opening therebetween.

11. The modular play structure of claim 10, wherein the plurality of connectors each defines four elongate receiving structures.

12. The modular play structure of claim 11, wherein each of the four elongate receiving structures has a width that is perpendicular to an adjacent elongate receiving structure on a connector.

13. The modular play structure of claim 10, wherein at least one of the plurality of wall units has two coupleable wall edges that are perpendicular, and the at least one wall unit has one of the following shapes: a rectangle, a square, and an L-shape.

14. The modular play structure of claim 10, wherein each of the plurality of wall units has at least three coupleable wall edges.

15. The modular play structure of claim 10, wherein each of the plurality of wall units defines at least one accessory opening, and the play structure further comprises a plurality of accessories each configured to releasably couple with each of the at least one accessory opening.

16. The modular play structure of claim 10, further comprising a plurality of decorative façades configured to removably attach to at least a portion of the plurality of wall units.

17. The modular play structure of claim 10, wherein at least one of the plurality of connectors is slidable relative to each of the elongate interlocking structures.

18. The modular play structure of claim 10, wherein the play structure comprises a plurality of walls and each wall is defined by at least three and no more than sixteen wall units.

19. The modular play structure of claim 10, further comprising at least two wall units each having a rectangular face, and two wall units each having an L-shaped wall face releasably interlockable by a plurality of connectors to form a door opening therebetween.

* * * * *